United States Patent [19]

Mansfield et al.

[11] Patent Number: 4,808,986

[45] Date of Patent: Feb. 28, 1989

[54] GRAPHICS DISPLAY SYSTEM WITH MEMORY ARRAY ACCESS

[75] Inventors: Robert L. Mansfield, Austin, Tex.; Marc Segre, Rhinebeck, N.Y.; Alexander K. Spencer, Austin; Joe C. St. Clair, Round Rock, both of Tex.

[73] Assignee: International Business Machines Corporation, Armonk, N.Y.

[21] Appl. No.: 13,840

[22] Filed: Feb. 12, 1987

[51] Int. Cl.[4] ..... G09G 1/14

[52] U.S. Cl. ..... 340/747; 340/723; 340/732; 340/798; 340/799

[58] Field of Search ..... 340/723, 732, 744, 747, 340/749, 750, 789, 798, 799; 364/518, 521, 719

[56] References Cited

U.S. PATENT DOCUMENTS

| | | | |
|---|---|---|---|
| 4,208,810 | 6/1980 | Rohner et al. | 364/521 |
| 4,272,808 | 6/1981 | Hartwig | 364/521 |
| 4,458,330 | 7/1984 | Imsand et al. | 340/747 |
| 4,496,944 | 1/1985 | Collmeyer et al. | 340/747 |
| 4,580,236 | 4/1986 | Tsujioka et al. | 340/732 |
| 4,623,880 | 11/1986 | Bresenham et al. | 340/723 |
| 4,642,625 | 2/1987 | Tsunehiro et al. | 340/747 |
| 4,691,295 | 9/1987 | Erwin et al. | 340/747 |
| 4,701,864 | 10/1987 | Takashima et al. | 340/723 |
| 4,703,317 | 10/1987 | Shiomi et al. | 340/723 |
| 4,706,205 | 11/1987 | Akai et al. | 340/723 |

OTHER PUBLICATIONS

*IBM Technical Disclosure Bulletin*, vol. 28, No. 5, Oct. 1985, "Circuit for Updating Bit Map-Memory of A Display Adapter", pp. 2240-2243.

*IBM Technical Disclosure Bulletin*, vol. 27, No. 8, Jan. 1985, "Raster Graphics Drawing Hardware", pp. 4618-4622.

*IBM Technical Disclosure Bulletin*, vol. 28, No. 6, Nov. 1985, "Graphic Bit-Bit Copy Under Mask", pp. 2721-2724.

*Fundamentals of Interactive Computer Graphics*, by James D. Foley and Andries VanDam, published by Addison-Wesley Publishing Company, 1982, pp. 433-435.

*Primary Examiner*—John W. Caldwell, Sr.
*Assistant Examiner*—Jeffery A. Brier
*Attorney, Agent, or Firm*—Thomas E. Tyson

[57] ABSTRACT

A graphics display system including a circuit that receives graphics information to be displayed and a memory that stores the graphics information in a memory array that includes a portion that directly corresponds to the image area for display. The memory provides a single access operation to the array during a single memory cycle. Circuitry is provided that is connected to the receiving means and to the memory that provides graphics information to an N by M portion of the memory array during a single memory cycle (wherein N and M are integers each greater than one). A display is connected to the memory that displays the graphics information contained in the image area array portion of the memory. The graphics display system further includes the capability to provide a patterned line intersection where the continuity of the line pattern is maintained along the intersection of the lines.

22 Claims, 13 Drawing Sheets

| | | | |
|---|---|---|---|
| 3 | 2 | 1 | 0 |
| 7 | 6 | 5 | 4 |
| 11 | 10 | 9 | 8 |
| 15 | 14 | 13 | 12 |

FIG. 13
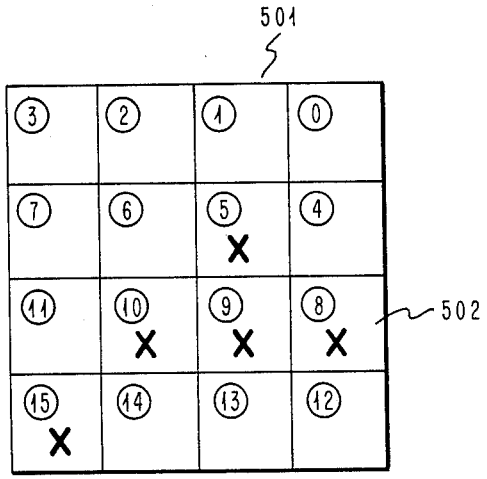
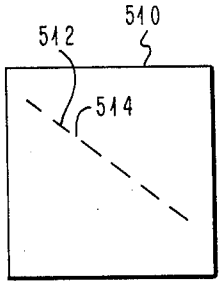
FIG. 15
FIG. 16
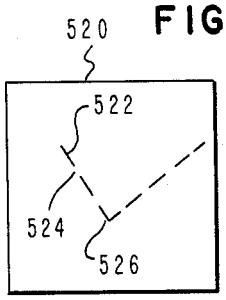
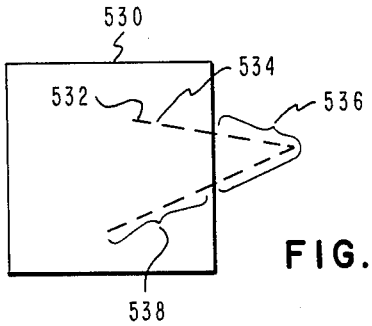
FIG. 17

GRAPHICS DISPLAY SYSTEM WITH MEMORY ARRAY ACCESS

CROSS REFERENCE TO RELATED COPENDING APPLICATIONS

U.S. patent application No. 07/013,842 entitled "High Resolution Graphics Display Adapter" filed Feb. 12, 1987, relates to an overall high of the present invention has particular utility.

U.S. patent application No. 07/013,848 filed Feb. 12, 1987, entitled "Vector Generator With Direction Independent Drawing Speed For An All Point Addressable Raster Display" discloses a novel vector line drawing circuit for use with raster scan type video displays and having both improved speed and versatility of function.

U.S. patent application No. 07/013,847 filed Feb. 12, 1987, entitled "Pixel Data Path For High Performance Raster Displays With All Point Addressable Frame Buffers" discloses a channel architecture which could be utilized in the data path feeding the frame buffer of such an adapter and which enables a number of versatile pixel data operations within the frame buffer. The hardware of this application would be located within the pel in processor "block" of application Ser. No. 07/013,842.

U.S. patent application No. 07/013,843 filed Feb. 12, 1987, entitled "A Frame Buffer Capable of Accessing Aligned Square Words of the Screen" discloses a frame buffer architecture which permits a substantial increase in the speed of a number of display operations as well as enhancing the versatility of the adapter in terms of the functions that may be performed off line. The hardware of this application would be located in the "frame buffer" block of application No. 07/013,842.

U.S. patent application No. 013,841 filed filed Feb. 12, 1987, entitled "A Graphics Display System Function Circuit" discloses a graphics function address circuit similar to that set forth in the above referenced U.S. patent application No. 07/013,848 which is uniquely suited to the overall video display adapter architecture set forth in the above referenced application Ser. No. 07/013,842.

U.S. patent application No. 07/013,849 filed Feb. 12, 1987, entitled "A Graphics Function Controller For A High Performance Video Display System" discloses circuitry for performing line drawing and bit block transfer operations in the pel processor block of application Ser. No. 07/013,842.

1. Technical Field

The present invention relates to computer graphics and more specifically to an apparatus for providing graphics information to a graphics image memory.

2. Background Art

The evolution of computer technology has resulted in the creation of a sophisticated technical area devoted to the representation of graphics information generated by computers. This area is termed computer graphics. One graphics technique commonly used to produce an image is that of producing a set of points and connecting these points with straight lines. The resulting combination of points and straight lines are displayed on the computer graphics terminal display which normally includes a cathode ray tube (CRT). The cathode ray tube includes an array of picture elements. The graphics image is produced by illuminating selected picture elements of the array. This array of picture elements in a display corresponds to the memory locations in an image memory. This image memory is often termed a bit map memory. The corresponding CRT display is termed a bit mapped display.

A very useful function for bit map displays is the ability to move a rectangular block of illuminated picture elements (pels) from one place in the bit map (or display) to another place and to logically combine two subsets of the image array to produce a third image array. Another useful function is that of drawing lines between two points. The technique often used to draw these lines is disclosed in a text entitled *Fundamentals of Interactive Computer Graphics* by James D. Foley and Andries Van Dam published by Addison Wesley Publishing Company, 1982 and herein incorporated by reference.

Discussions of graphic functions are contained in several IBM Technical Disclosure Bulletins. *IBM Technical Disclosure Bulletin,* Vol. 28, No. 6, November 1985, entitled "Graphic Bit-Blt Copy Under Mask" discloses a system for making bit boundary block transfers f arbitrary shapes within a frame buffer. *IBM Technical Disclosure Bulletin,* Vol. 27, No. 8, 1985, entitled "Raster Graphics Drawing Hardware", describes the application of programmable logic arrays to the design of hardware circuitry implementing graphics drawing algorithms. *IBM Technical Disclosure Bulletin,* Vol. 28, No. 5, October 1985, entitled "Circuit for Updating Bit Map-Memory of A Display Adapter", discloses a circuit for providing bit manipulation flexibility to control picture element data stored in an all points addressable display memory.

An object of the present invention is to provide a graphics producing apparatus that rapidly transfers image information to an image memory.

DISCLOSURE OF THE INVENTION

In accordance with the present invention a graphics display system is provided that includes a circuit for receiving graphics information to be displayed and a memory for storing the graphics information in an array. The array includes a portion that directly corresponds to the image area for display. The memory includes a circuit for providing an access operation to the array during a single memory cycle time. The graphics display system further includes a circuit connected to the receiving circuit and the memory that provides graphics information to an N by M portion of the memory array means during one of the memory cycles (where N and M are integers each greater than 1). A display is connected to the memory for displaying the graphics information in the image area array portion of the memory.

In one embodiment of this invention the circuit connected to the receiving circuit in the memory includes a control circuit that provides control signals to the memory. The control circuit provides control signals that indicate data to be provided to the memory. In this embodiment the control circuit further includes a register that contains the pattern of data to be provided to the memory. This register actually designates which control signals are to be transmitted to the memory. The transmitting of the control signals is actually an indication of data pattern provided to the memory. In this embodiment a plurality of data lines are provided for transmitting data to the memory. A portion of these data lines are interconnected together to provide the same data. The transmission of data on these data lines is regulated by the control signals such that even though data on a specific data line may be available, it will not be transmitted to the memory if the pattern contained in the control register so indicates.

In this embodiment, the control signals include row and column strobes and a write enable signal. The write enable signal is selectively generated to determine which of a predetermined set of data lines will be written to the memory. In this embodiment a circuit is used to write an N by M array into a memory area that contains the graphics image to be displayed. The writing of the array is accomplished in a single memory cycle by selectively controlling the write enable control signals as described.

In this embodiment, the memory array is configured to store data designating characteristics of picture elements for the display. In this embodiment, eight bits are used to describe each picture element. The memory accessing circuitry accesses N by M picture elements in a single memory cycle.

The capability to address the N by M array increases the speed at which line draw functions and bit block transfer functions can be accomplished in the graphics display system.

BRIEF DESCRIPTION OF THE DRAWING

The novel features believed characteristic of the invention are set forth in the appended claims. The invention itself, however, as well as other features and advantages thereof, will be best understood by reference to the following description of the preferred embodiment, when read in conjunction with the accompanying figures, wherein:

FIG. 13 is an illustration of a 4×4 pel matrix for a bit block transfer operation;

FIG. 15 is an illustration of a pattern line;

FIG. 16 is an illustration of two intersecting lines where the pattern is continued from one line to the other; and FIG. 17 is an illustration of two lines including portions drawn off of an active display area.

BEST MODE FOR CARRYING OUT THE INVENTION

This invention is included in a computer terminal display adapter circuit. This adapter circuit is a high resolution graphics display adapter that in the preferred embodiment drives an IBM 5081 display monitor unit. This circuit provides a resolution of 1024 by 1024 picture elements with 256 simultaneous colors from a palette of 4,096 possible colors. A general description of this display adapter circuit follows.

Display Adapter—General Description

Figure 1:
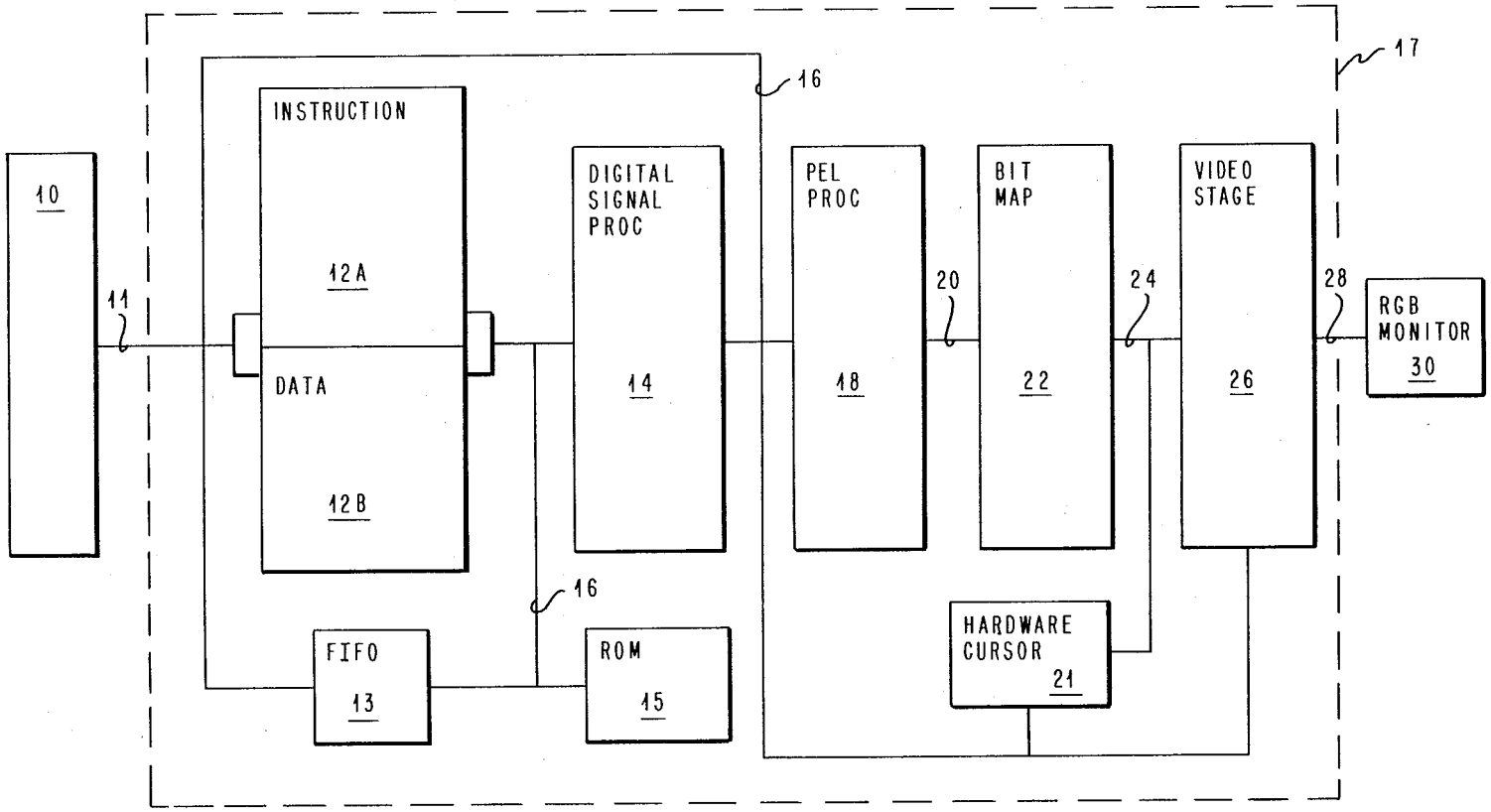
FIG. 1 is a block diagram illustrating the display adapter circuit connected to a processor and monitor.

FIG. 1 is a block diagram illustrating the display adapted circuit 17 connected for operation. Specifically, display adapter circuit 17 is connected to a system processor 10 by a system I/O bus 11. Additionally, the adapter circuit 17 is connected to a RGB monitor 30 by an output bus 28. The display adapter circuit 17 includes two memories 12A and 12B that are connected to a digital signal processor which is used for circuit resource management and is further used to transform coordinates. In the preferred embodiment, the digital signal processor is of a Harvard architecture requiring separate memories for data and instructions. Memory 12A is an instruction RAM that is loaded with microcode to provide instructions to the signal processor 14. The memory 12B is a data RAM that provides a primary interface between the signal processor 14 and the system processor 10 and also forms the main data store for the signal processor 14. In the preferred embodiment, 256K bytes of memory are provided for memory 12B. In this embodiment, however, the digital signal processor 14 has an address space of only 128K bytes. Therefore, a bank switching mechanism is provided. Furthermore, in this preferred embodiment memory located outside of the adapter circuit 17 may be mapped into the digital signal processor 14 address space.

A first-in, first-out buffer 13 is provided for passing sequential display commands from the data memory 12B to the digital signal processor 14. Further, an instruction ROM 15 is connected via bus 16 to provide the power on and self-test instruction microcode programs for the digital signal processor 14.

A pel (picture element) processor 18 is also connected to bus 16. The function of the pel processor 18 is to draw lines, and provide for manipulation of areas of data on the display screen and provide bit map memory control. This manipulation of areas on the display screen is termed bit block transfer or BITBLT. The pel processor 18 also includes control and status registers that along with other functions allow the system processor 10 to interrupt, disable or reset the signal processor 14 and allow the signal processor 14 to interrupt the system processor 10.

The pel processor 18 is connected via bus 20 to a bit map memory 22. The bit map memory 22 is organized as 1024 by 1024 by 8 bits. The bit map memory 22 also includes the capability to provide an overlay plane that can be used to provide blinking or highlighting to data on the display.

A video stage 26 is connected to the bit map memory 22 via bus 24 and transforms the data in the bit map memory 22 into a video signal for the video monitor 30. This video stage 26 provides this transformation via a digital to analog circuit. A color palette circuit is also included in the video stage 26 that provides 256 simultaneously displayable colors from a larger palette of colors. This is accomplished through video lookup tables that translate the value in the bit map to a value with more bits and thus a greater range of colors is provided. With this greater range of values provided by the color palette, more colors are provided than would be provided by use of the bits in the bit map memory 22 alone.

A hardware cursor 21 is connected to the video stage 26 via bus 24 and provides a full screen cross hair and/or a bit programmable cursor. The full screen cross hair can be programmed to one of several widths. In addition this cross hair can also be scissored (reduced in size) to provide various smaller sizes.

In the preferred embodiment, the display adapter circuit 17 uses the digital signal processor 14 as a primary interface to the system processor 10. In this embodiment, the digital signal processor is a Texas Instruments TMS 32020 digital signal processor which executes 5 million instructions per second. Therefore, it is well suited to perform such tasks as matrix multiplications which are used to translate, scale and rotate vectors on the screen. The digital signal processor can address a data space of 64K of 16 bit words and an instruction space of the same size. As mentioned earlier, a portion of the data space may be located within the adapter circuit 17 or remote from the adapter circuit 17. The digital signal processor 14 can be interrupted by the system processor 10 or by the pel processor 18. The pel processor 18 can generate interrupts to the digital signal processor 14 or the system processor 10 upon the occurrence of a task complete condition or the condition where a vertical retrace has been started. In addition, the digital signal processor 14 also includes a timer which can be used to control the time between display updates.

The ROM 15 is provided with the initial power-up instruction sequence for the digital signal processor 14. In the preferred embodiment, the ROM 15 is provided with 16K bytes of information and includes a power-on self-test program and a graphics display adapter emulation program. The power-on self-test program provides an indication that immediately after a power-up condition or a reset condition that the adapter circuit 17 is functioning properly.

The data RAM 12B provides 256K bytes of RAM in the adapter circuit 17 for the signal processor 14 to use as storage. 1K byte of the 256K byte data space is overlayed by the signal processor 14 internal registers. The data memory 12B consists of dynamic RAM, which is refreshed by logic within the display adapter circuit 17. This memory is operated in a page mode so that accesses to two words loaded on the same page (i.e., in the preferred embodiment in the high order 8 address bits) will require no wait states for the digital signal processor 14. Accesses to words on a new page will result in a single wait state. Thus, locating frequently referenced data in internal registers or grouped together on a single RAM page will increase performance by not incurring any wait states. Although the digital signal processor 14 data addressing capacity is limited to 64K words, a bank switching mechanism is provided to extend its address space. This scheme allows a full access to the data memory 12B. Presently, four banks (64K bytes for each bank for a total of 256K bytes) have been implemented. However, the address logic in architecture may provide for up to 16 banks in this preferred embodiment. In this embodiment, the RAM is dual ported, that is the system processor 10 and the signal processor 14 have concurrent access to it. Since both processors 10 and 14 have easy access to this memory, it provides for a convenient communications channel between the two processors 10 and 14. In this embodiment, the signal processor 14 can also address memory located remote from the display adapter circuit 17 as an extension of this data RAM 12B, by first acting as a first party bus master on bus 11. Both memory on the I/O bus 11 and within the system processor's 10 main memory may be accessed in this manner. The signal processor 14 can put a full 24 bit address on bus 11 and so has a potential of addressing 16 megabytes of memory. The mapping of data space remote from the adapter circuit 17 is controlled by a Bank/Extended Address Register within the signal processor 14. The 16 bit address bus of the signal processor 14 is extended to 24 bits with this register. Access may be made in burst mode, buffered mode, or singly. The length of the burst in burst mode is software controllable. Four to sixteen wait states are required for access to remote memory.

The instruction memory 12A provides 128K bytes of memory in the preferred embodiment to the digital signal processor 14 to use as an instruction space. This is in addition to the instruction space provided by ROM 15. However when the ROM 15 is mapped into an instruction space, it overlays an equivalent amount of instruction RAM 12A. This is done because the digital signal processor 14 can only address a total instruction space of 128K bytes. The instruction memory 12A consists of dynamic RAM which is refreshed by logic on the adapter circuit 17. The instruction RAM 12A is operated in a page mode so that access to words located on the same page (i.e., the high order 8 bits) requires no wait states for the signal processor 14. Accesses to a new page results in one wait state. Therefore, locating frequently executed code loops on the same page within the instruction memory 12A or within the signal processor 14 internal instruction memory will provide a maximum execution speed. This instruction memory 12A is also dual ported providing concurrent access from the system processor 10 or the signal processor 14.

The FIFO buffer 13 is 1K words in length. When there is space in buffer 13, the system processor 10 may load commands and/or data into this buffer providing access to the digital signal processor 14 which can then sequentially access this information. In this embodiment, display information from the system processor 10 is provided. The buffer 13 includes three flags: empty flag, half full flag and full flag which can be read by the system processor 10 to determine if there is room to write more information into this buffer 13. In addition to the flags, this buffer 13 has three interrupts associated with it. A half full interrupt, a half empty interrupt and a buffer overflow interrupt are provided. The first two may be used to pace write operations to the buffer 13 without polling the flags, while the last would normally be considered an error condition. The digital signal processor 14 also has access to the flags to determine if more information can be read from the buffer 13.

The pel processor 18 assists the signal processor 14 in updating the bit map memory 22 quickly. The pel processor 18 can either draw lines into the bit map memory 22 or manipulate rectangular blocks of data bits (BITBLT) in the bit map memory 22. When line drawing, the pel processor 18 can either be given the end points of the line, with Bresenham's parameters calculated by the pel processor 18, or the end points along with the parameters needed by the Bresenham's incremental line drawing algorithm. The latter approach allows more control over the vector to raster translation and may be useful for special cases such as wide lines. In addition, line attributes of color and pattern are supported directly by the pel processor 18. Support of the line width attribute requires some intervention by the signal processor 14. Lines may be drawn in replace mode, exclusive OR mode, or line on line mode.

Bit block transfers are also performed by the pel processor 18. Some of the bit block transfers operate with minimal processor intervention while others require more intervention. The bit block transfer includes the operation of an inner loop and an outer loop and the implementation in this embodiment provides that the inner loop may be either horizontally or vertically oriented. This option is particularly useful when transferring images of character strings to the bit map memory 22. In addition, the pel processor 18 has the ability to provide bit block transfers with color expansion. Color expansion is defined as the process of taking data in which each active bit represents a pixel of a known color and a zero indicates transparency (i.e., the frame buffer is not altered for this pixel location). This mode offers a performance advantage as each word of data represents 16 pixels of screen memory rather than 2.

When using color expansion, a special feature associated with the Direct Write Mask, a capability of the pel processor 18, allows the object being transferred to be rotated in any one of four possible 90 degree orientations.

The digital signal processor 14 or the system processor 10 can define an active region of the bit map memory 22 where drawing occurs. For line draw and block transfer operations, only pels that are to be drawn in this active region will be written to the bit map memory 22. Line draw and block transfer operations resulting in drawing outside of this area will be performed but the resulting pel information will not be written to the bit map memory 22. The use of this active drawing region is termed scissoring.

A further feature of the pel processor 18 is the pick window. This window can be defined to the pel processor 18 and when enabled any access to the frame buffer within this window causes an interrupt to the signal processor 14. This can be used while drawing objects to identify any part of the object which falls within the specified window.

The pel processor is normally controlled by the signal processor 14, however, the system processor 10 may disable the signal processor and control the pel processor 18 directly. The pel processor 18 will be discussed in more detail later.

The bit map memory 22 consists of 1 megabyte of video RAM. The bit map memory 22 is displayed on the screen as a 1024 by 1024 pel image with 8 bits per pel. The pel processor 18 acts as the interface between the system processor 10 or signal processor 14 and the bit map memory 22. Depending upon how some of the bits located within the pel processor 18 are set, the bit map memory 22 will be read as either two horizontally adjacent pels or four horizontally adjacent half pels (wherein a half pel is defined as either the first four or last four bits of a full pel). In all addressing modes, the bit map memory 22 is pel addressable. That is, X and Y address registers in the pel processor 18 are used to indicate the pel being addressed.

Figure 2:
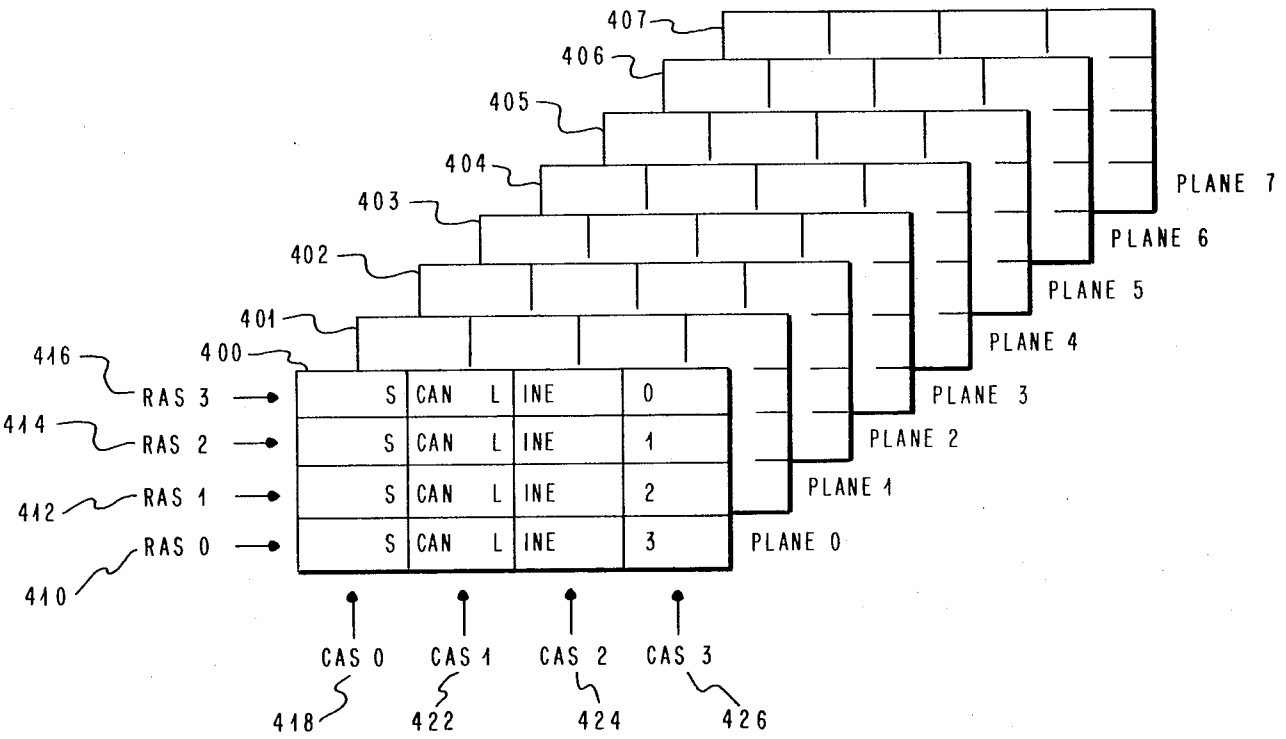
FIG. 2 is a diagram illustrating the organization of the bit map memory 22.

The organization of the bit map memory 22 is shown in FIG. 2. The pels are arranged in 4×4 squares. Each pel is 8 bits deep. The 8 bits represent 8 planes 400 through 407. Pel memory modules on the same rows share a common row address strobe (RAS) line. Those in the same column share a common address strobe (CAS) line. The same address lines are shared by all the pel memory modules. Both the serial data lines used to refresh the screen and the parallel data lines used to read and write the bit map are connected in columns. Thus, data can be read from one of four layers and loaded into accumulators. Each of the 16 pel memory modules in the 4×4 array has its own write enable that is controlled by the direct mask register and the Bresenham line drawing circuits in the pel processor 18.

Figure 3:
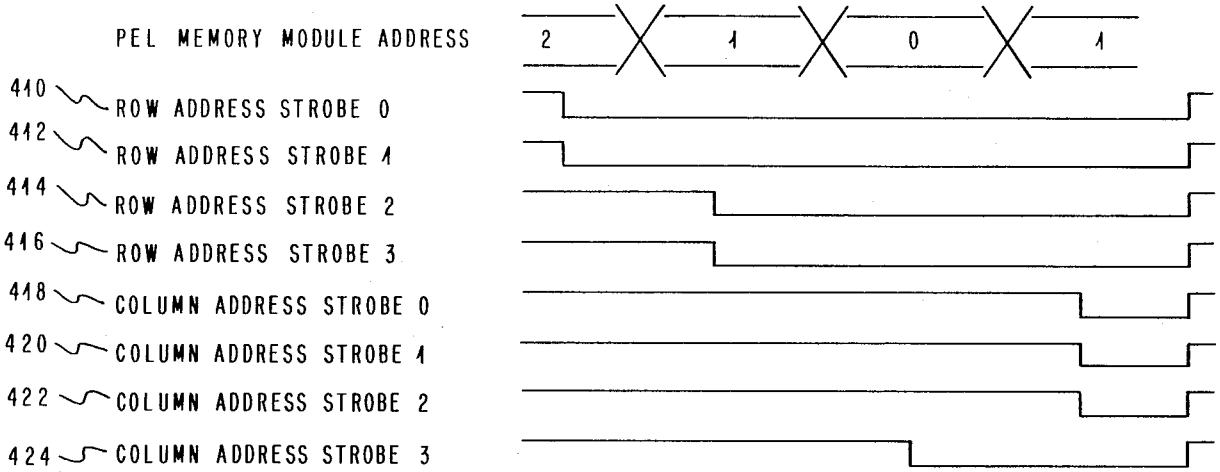
FIG. 3 is a timing diagram illustrating the timing control signals provided to the bit map memory 22 from the pel processor 18.
Figures 4, 5:
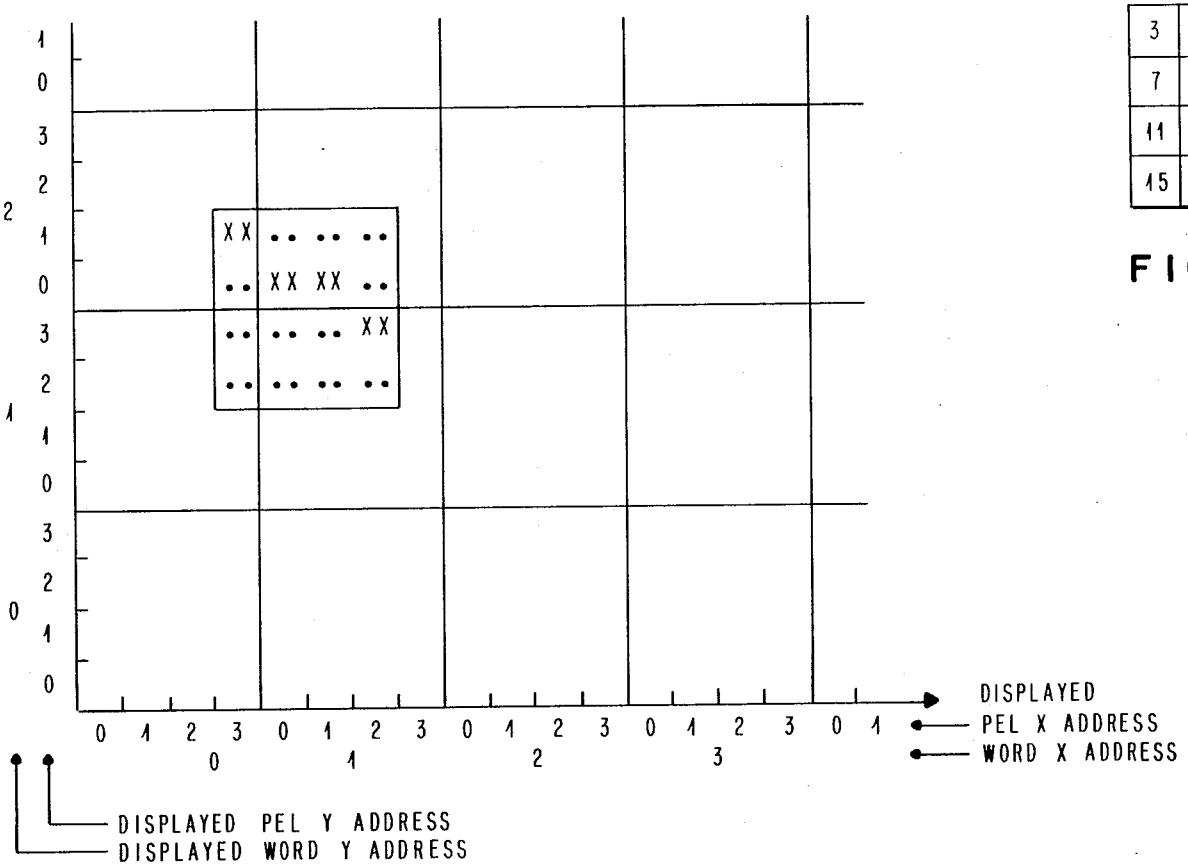
FIG. 4 is an illustration of a portion of a display screen illustrating the display of a 4×4 pel matrix upon a grid display.
FIG. 5 illustrates the address convention for a 4×4 pel matrix.

The multiple RAS lines 410, 412, 414, and 416 and the multiple CAS lines 418, 420, 422, and 424 are used to strobe different addresses in the pels. This allows the "access" 4×4 square word that is addressed by the X and Y pel address registers to be misaligned with the displayed words that are scanned onto the screen. FIG. 3 shows the waveforms for the RAS lines 410, 412, 414, and 416 and the CAS lines 418, 420, 422, and 424 that are used to strobe the addresses into the pel memory 22 and align the access word with respect to the displayed words. Note that this pel alignment of 4×4 words allows a corner of the square to be placed at the start of any line being drawn and, because each pel memory module has an independent write enable, 4 pels of the line can be drawn simultaneously as illustrated in FIG. 4. FIG. 5 illustrates the numbering of the pels in the 4×4 array.

An overlay plane, actually plane 7 (407 in FIG. 2) of the bit map memory 22 can be used in conjunction with the color palette feature of the video stage 26 to provide highlighting or blinking at a programmable rate. With blinking enabled any pixel with a 1 in this plane will blink at the programmable blink rate. With highlighting enabled a 1 in the overlay plane overrides the normal color palette process in the video stage 26 and substitutes a color from a three entry overlay color palette. Note that the use of the overlay plane will effectively reduce the available colors for the color palette feature in the video stage 26.

Returning to FIG. 1, the video stage 26 includes a color palette feature. The color palette translates the 8 bit value stored in the bit map memory 22 into one of 4,096 colors. The output of this color palette feature provides 4 bits to each of 3 digital to analog convertors. The digital to analog convertors in turn drive the red, green and blue color guns of the monitor 30. Each 4 bit section of the look-up table maps the 8 input bits from the bit map into one of sixteen analog output levels. The color palette feature may be loaded by the signal processor 14 or when the signal processor 14 is disabled, by the system processor 10.

The hardware cursor 21 provides a full screen cross hair and/or a 64×64 user programmable cursor. The full screen cross hair can be programmed to one of several widths and scissored. The output of the hardware cursor is fed to the color palette feature of the video stage 26.

In FIG. 1, the system processor 10 provides high level graphics orders to the signal processor 14. Status and other information is passed from the signal processor 14 to the system processor 10. The signal processor 14 breaks down the high level graphics orders from the system processor 10 into a series of low level graphics commands which are then passed to the pel processor 18 via the input bus 16. This input bus 16 includes address, data and control information. If the signal processor 14 has been disabled, the system processor 10 can transfer low level commands and retrieve data directly from the pel processor 18 by means of the input bus 16. Access to the bit map memory 22 is controlled by the pel processor 18. The accesses to the bit map memory 22 take place over bus 20 which provides address data and control information.

Pel Processor—Description

Figure 6:
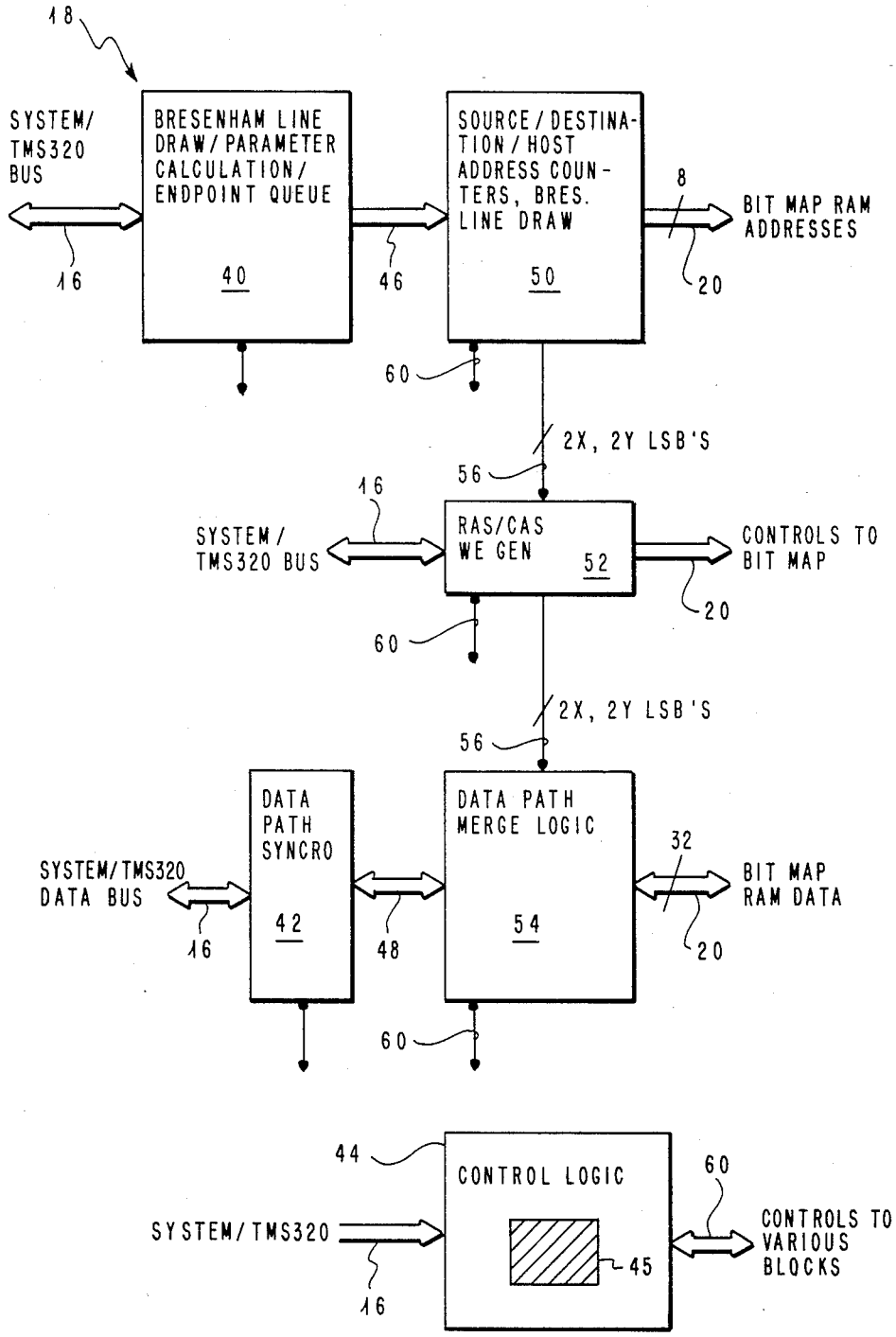
FIG. 6 is a block diagram of the pel processor 18.

A block diagram of the pel processor 18 is shown in FIG. 6. Control of the bit map memory 22 in execution of low level graphics command is achieved by writing control parameters from either the system processor 10 or the signal processor 14 into the pel processor control logic 44 via the input bus 16. These parameters are decoded within the dynamic control mechanism 45, generating control and timing signals for the other parts of the pel processor circuitry and which are provided via line 60. The endpoint address information for a low level order is communicated to the pel processor 18 by the pel processor input bus 16 and stored in the input queue contained in the endpoint logic 40. Depending on the order being processed (either line draw or bit block transfer), various operations are performed. If a line draw order is being executed, the endpoint data is used to calculate parameters used in executing Bresenham's line draw algorithm in the address count logic circuitry 50. For block transfer operations, the endpoint logic 40 simply queues the input data until this data can be transferred to the address count logic 50. Communications of the endpoint and line draw parameters from the endpoint logic 40 to the address count logic 50 takes place over the address/parameter bus 46. When these parameters have been loaded into the address count logic 50, the endpoint logic 40 is free to accept new endpoint data for the next graphics order. The address count logic 50 uses the parameters to generate the bit map addresses needed to complete the order being executed, and, in addition uses some parameters to sequence the task and determine when the task has been completed.

The address count logic 50 manipulates coordinates in 10 bit fields. The upper 8 bits of the field form the bit map memory addresses 20. The lower 2 bits of both the X and Y coordinates are passed to the RAM control logic 52 via the pel bus 56 where they are decoded into bit map control signals on line 20. These bits are also passed to the data path merge logic 54 via the pel bus 56 where they are used to control data being stored into or retrieved from the bit map memory 22. The data path merge logic 54 serves as the bridge between the system and display processor buses and the bit map memory data bus 20. System processor 10 data can be transferred between or combined with bit map data using the merge logic 54. Data being transferred to and from the system processor 10 is controlled by the data path synchronization circuitry 42 and passed via the merge bus 48.

Figure 7A:
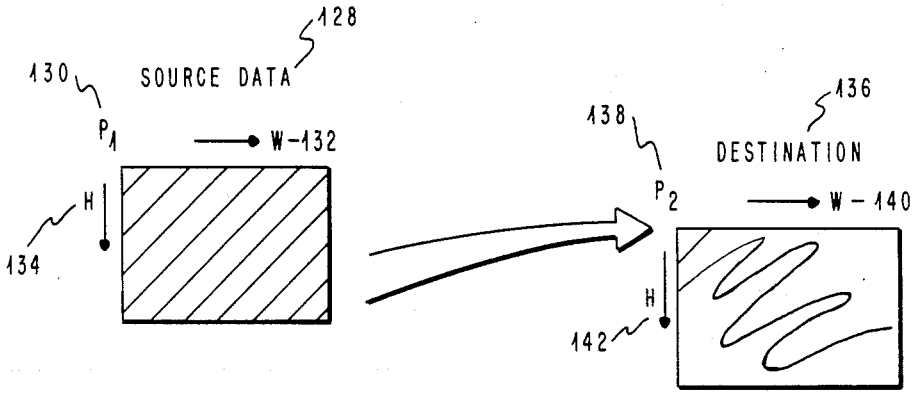
FIG. 7A illustrates a bit block transfer function.
Figure 7B:
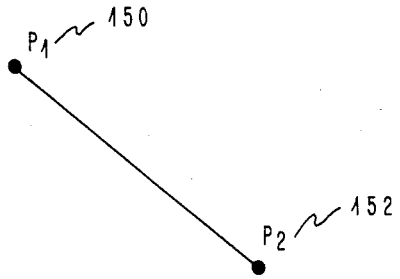
FIG. 7B illustrates a line draw function.

The following is a more detailed explanation of the two main graphics tasks that are performed by the pel processor 18. These two tasks are illustrated in FIGS. 7A and 7B. The bit block transfer task (FIG. 7A) consists of moving rectangular blocks of data from a source area of the bit map memory 22 to a destination area of the bit map memory 22. This task is commonly used to "scroll" information on the screen or to display a pop-up menu. Line drawing (FIG. 6B) which consists of connecting two points in the bit map memory 22 via straight line, is also a commonly used function. Both of these tasks form the foundation of higher level graphics operations, such as multiple source bit block transfers, pattern lines, polygon drawing, etc. For this reason, it is essential to perform these base functions as effectively as possible.

In FIG. 7A, it is desired to move a data block from location 128 to location 136. In order to perform a bit block transfer from the source location 128 to the destination location 136, the following sequence of events must take place within the pel processor 18. Once the pel processor 18 control logic 44 (FIG. 6) is loaded with control parameters to perform a bit block transfer operation, the endpoint data for Pl (130) and P2 (138) along with the height parameter (134) and the width parameter (132) are loaded into the endpoint logic 40 (FIG. 6). In executing a bit block transfer operation, the endpoint logic serves as an intermediate level of storage, passing the parameters to the address count logic 50 (FIG. 6) when the task is initiated. Loading the Y address value of P2 (138) signals the pel processor 18 to begin task execution. At this point, the address and parameter counters within the address count logic begin to access the bit map memory locations along with the width dimension of the bit block transfer, alternately accessing the source, then the destination addresses. When a string of accesses is completed along the width dimension, the address counters are automatically counted and reloaded to begin the next line. This process continues until the bottom of the bit block transfer is reached. The address counters generate a 10 bit pel address, and the upper 8 bits are used as the bit map memory address 20, while the lower 2 bits 56 are used as the pel decode in the RAM control logic 52 (FIG. 6), and the merge logic 54. The merge logic 54 takes the data read in from the source location, aligns it, and passes it out to be stored in the destination locations.

FIG. 7B illustrates a line draw task. In order to perform a line draw command, the end points of the line, Pl (150) and P2 (152) are loaded into the endpoint logic 40 (FIG. 6). Loading the Y address value of P2 (152) signals the pel processor 18 to begin execution. At this point, the endpoint logic begins to calculate the various Bresenham parameters associated with the line to be drawn. Once this calculation process is finished, the parameters are passed to the address count logic 50. To execute this line draw task, the address count logic will begin generating pel addresses for each pel in the line. The upper 8 bits of the address will serve as the bit map address 20 as before. The lower 2 bits 56 of the pel address are passed to the RAM control logic 52, where they are used to generate the appropriate write enables to draw the line into the bit map.

Figure 8A:
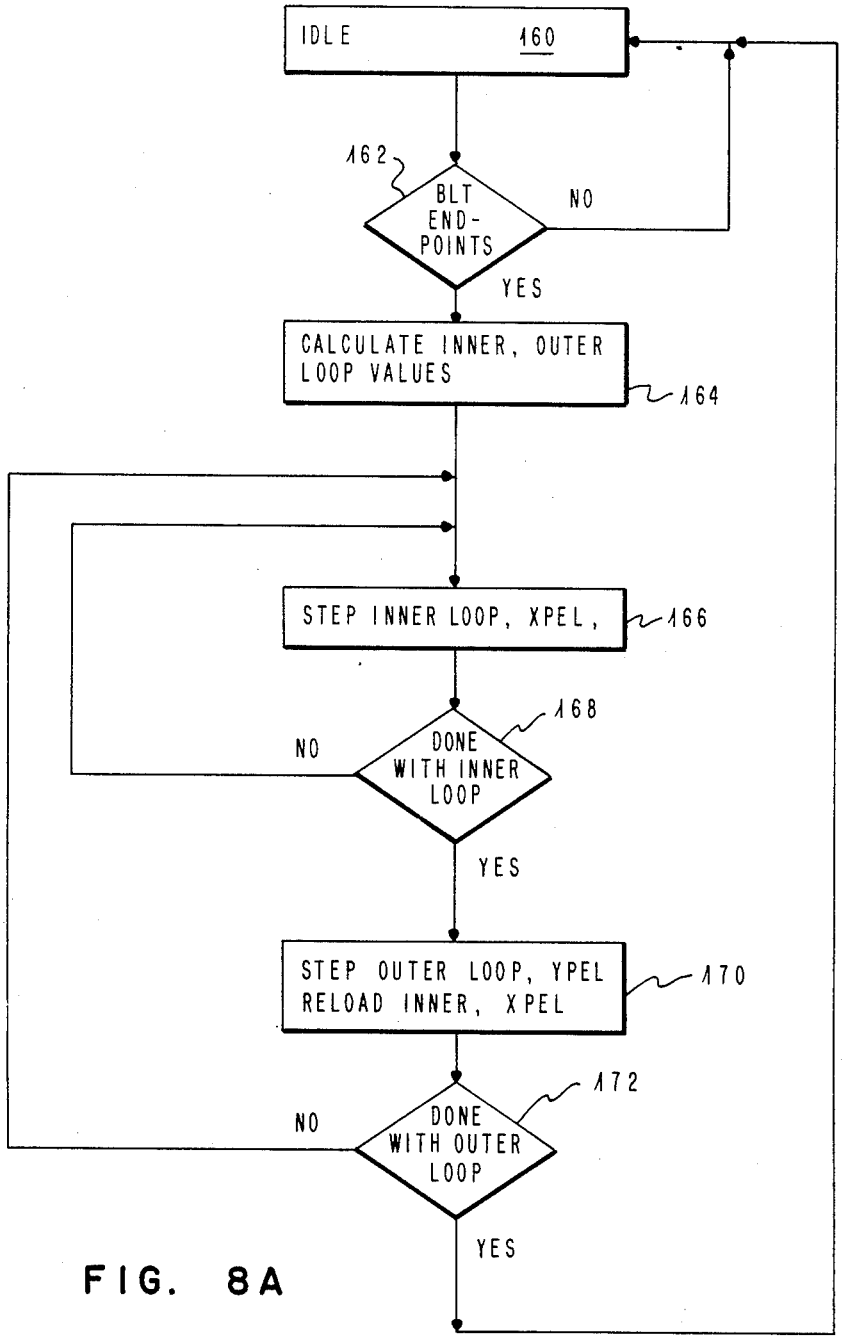
FIG. 8A is a flow diagram for the bit block transfer function task.

FIG. 8A is a software flow diagram illustrating the bit block transfer function. The pel process 18 is in the idle state 160 until it receives the bit block transfer end points as illustrated in step 162. If the end points have not yet been received, the pel processor 18 remains in a idle state 160 searching for the end points. When the end points have been received, the pel processor proceeds to step 164 to calculate the inner and outer loop values. In 166 the inner loop incrementing begins with the X pel address being incremented. In step 168 a decision is made as to whether or not the inner loop has been completed. If the inner loop has not been completed, the processor returns to step 166. If the inner loop has been completed, the processor proceeds to step 170 to step the outer loop set the Y pel and reload the inner loop counter. In step 172, a decision is made as to whether or not the outer loop has been completed. If the outer loop has not been complete, then the pel processor returns to step 166. If so, the pel processor returns to the idle state 160.

Figure 8B:
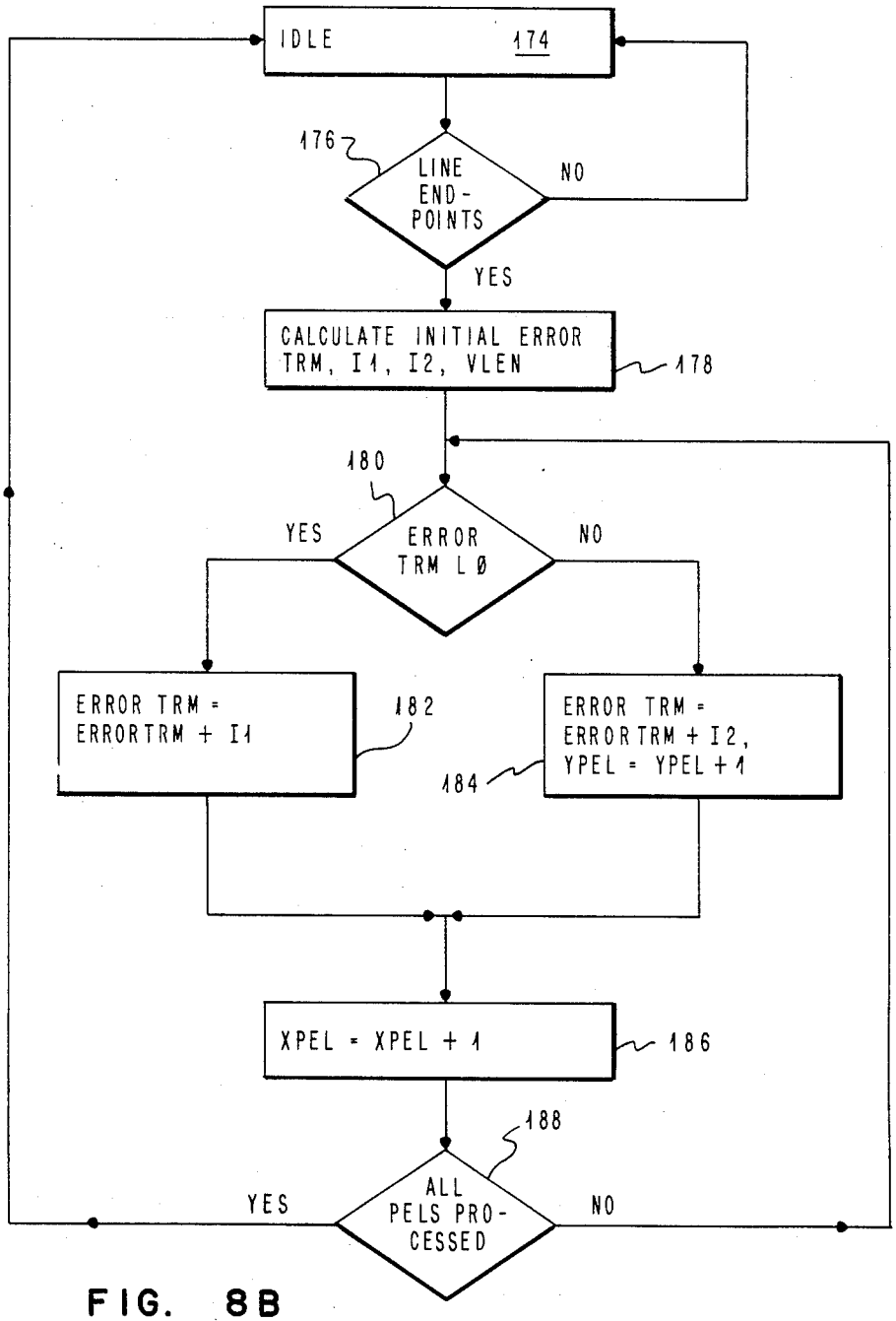
FIG. 8B is a flow diagram for a line draw task.

FIG. 8B illustrates a flow chart for the Bresenham line draw algorithm. The Bresenham algorithm is disclosed in the *Fundamentals of Interactive Computer Graphics* by James D. Foley and Andries Van Dam, published by Addison Wesley Publishing Company, 1982 and appearing on pages 433–435. An over simplified explanation of the Bresenham algorithm is that it determines which picture elements in an array of picture elements should be illuminated to represent an approximation of a straight line. Basically the algorithm uses the slope between the two end points to determine a set of parameters that are used to designate which pels are to be activated. In FIG. 8B, the pel processor 18 initially loops between an idle state 174 and a decision state 176 until the line end points have been received. When the line end points have been received, the processor proceeds to step 178 to calculate an initial error term, I1, I2, and the line length. The processor then proceeds to step 180 to determine if the error term is less than 0. If not, the pel processor 18 proceeds to step 184 where the error term is added to I2 and the Y pel address is incremented. The pel processor 18 proceeds to steps 186 to increment the X pel. A decision is made in step 188 to determine if all the pels have been processed. If not, the processor returns to step 180 to examine the error term. If the error term is less than 0, then the processor proceeds to step 182 to add the constant I1 to the error term. The pel processor 18 then proceeds to step 186 as before. When it is determined that all the pels have been processed (step 188), the processor returns to the idle state 174.

It should be understood that the slope of the line to be drawn and its direction will determine which address counter is being conditionally counted.

Referring to FIG. 6, the control signals for the memory 22 are provided from circuitry 52 that receives information over the system bus 16 plus addressing signals from lines 56 from the counter and line drawing circuit 50. Additionally, control signals on lines 60 from the control logic 44 are provided. The circuitry 52 provides the row address strobe and column address strobe signals to the memory 22. Additionally, the write enable control signals are provided. Traditionally the write enable control signal is used to designate a time period when the actual data is written into or read from the memory cells. The current invention uses the write enable to actually control the data that is input into the memory cells. In other words, the write enable signal is used to mask data that is written into memory. Normally that which is to be masked is loaded into a register and latched through a mask register. This is accomplished by the use of a second register containing the mask and the first register being combined with a second register to provide the mask output. This mask output is then provided to the memory. In the present invention this masking is accomplished by selectively generating the write enable signals for the data to be written to memory during a write to memory operation.

Figure 9:
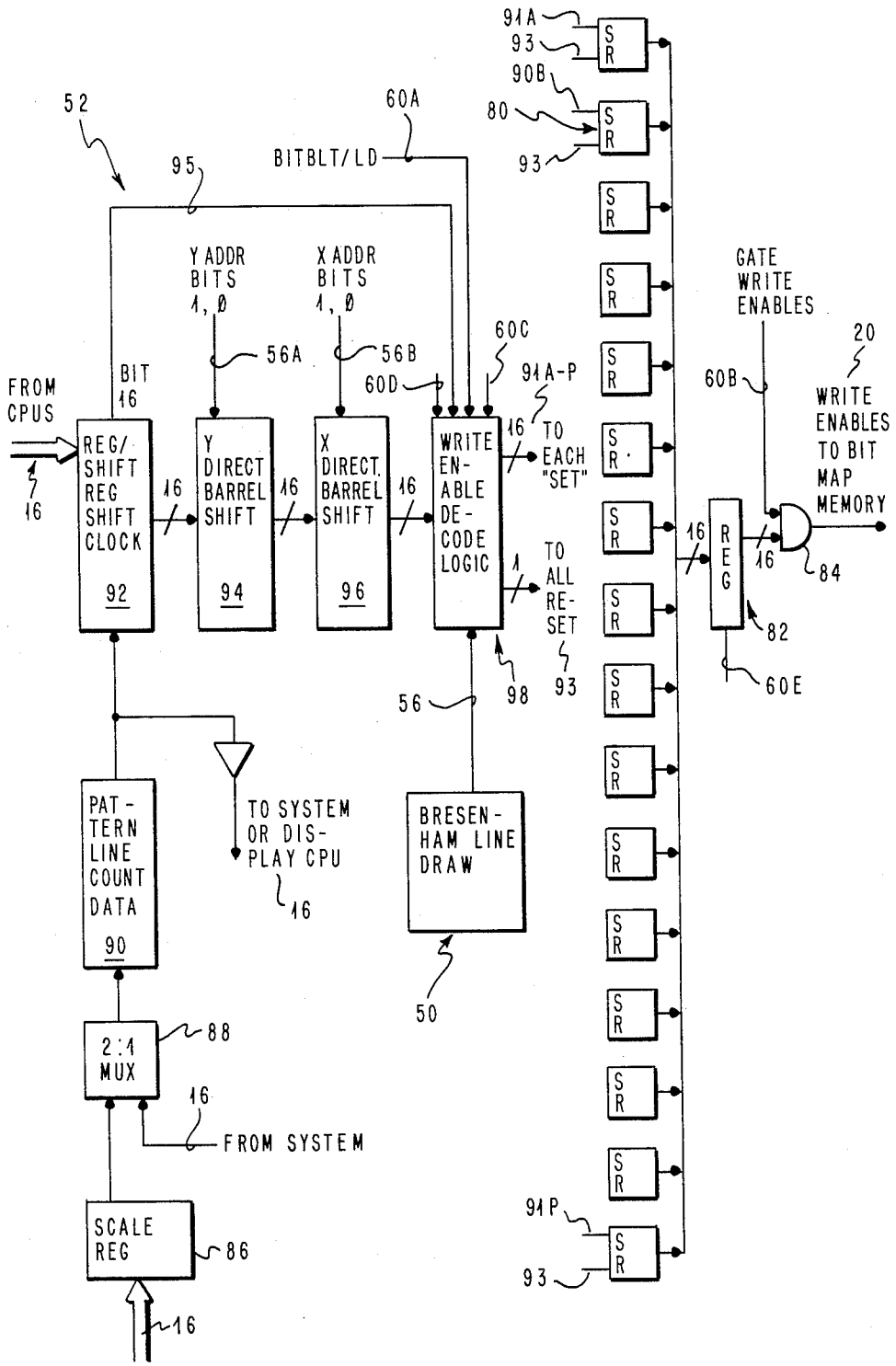
FIG. 9 is a block diagram illustrating the write enable mask circuitry of the pel processor 18.

FIG. 9 illustrates the write enable signal generation portion of the memory control circuitry 52. The circuitry illustrated in FIG. 9 provides the masking function for both a bit block transfer operation and a line draw operation. In the line draw operation, a pattern capability is provided where a specific pattern (a number of bits on and a number of bits off) may be provided for drawing lines. Additionally, patterns for 4×4 pel arrays may be provided for bit block transfer operations.

Figure 10:
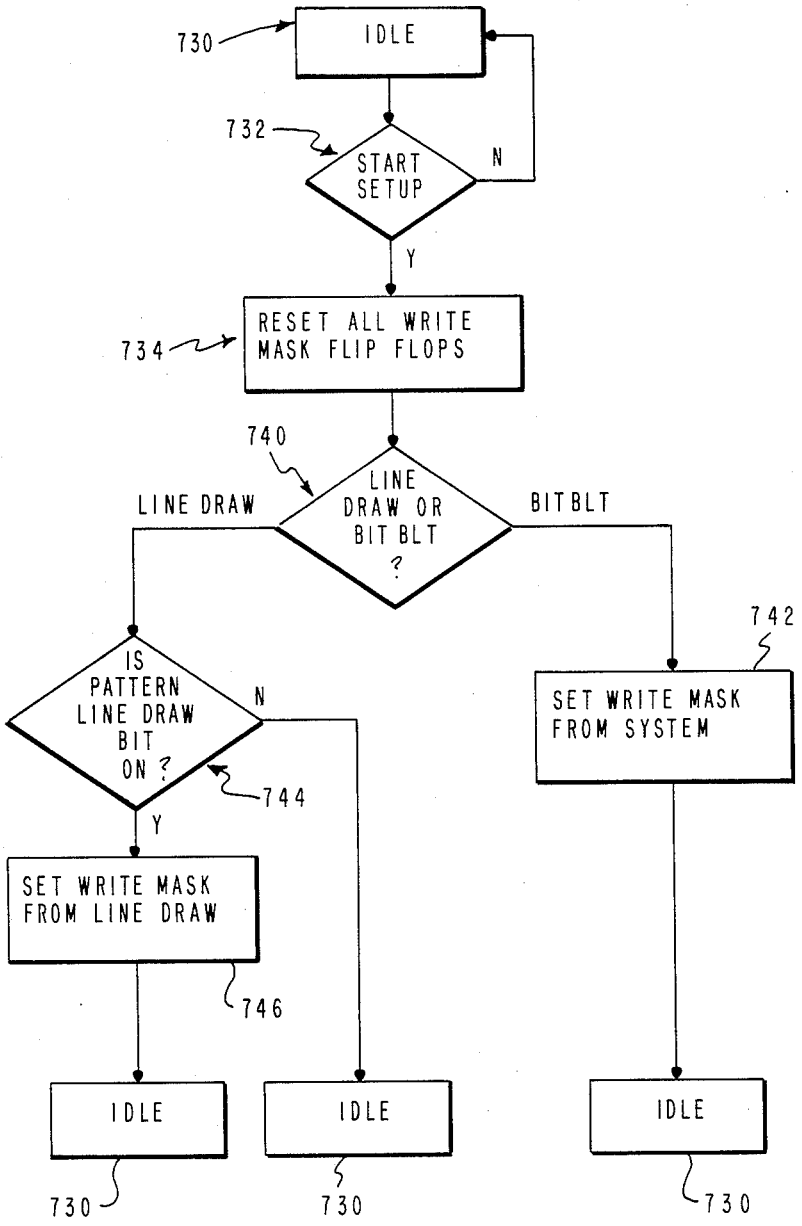
FIG. 10 is a flow diagram illustrating the operation of the control circuitry for the pel processor 18 with the write enable mask circuit.
Figure 11:
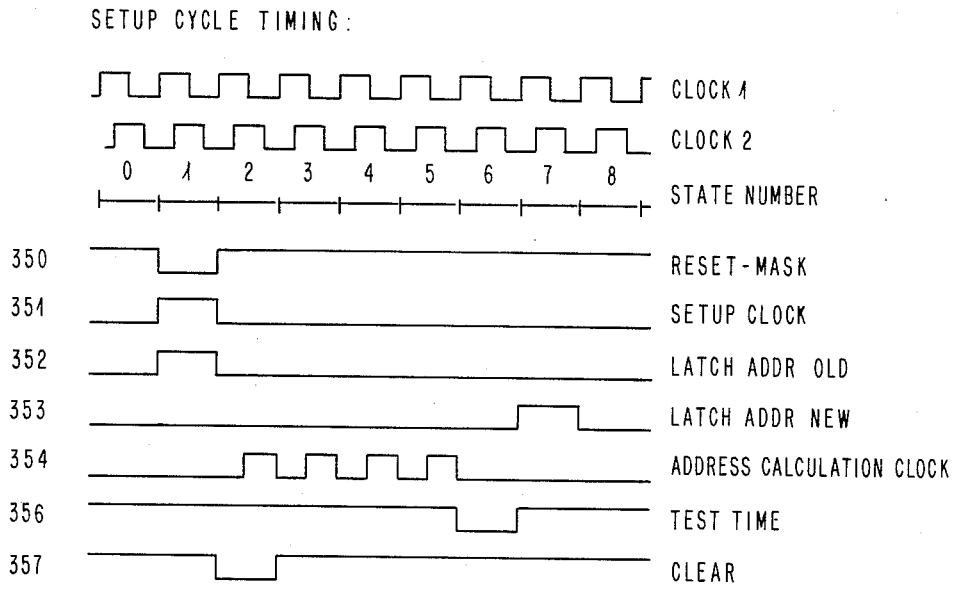
FIG. 11 is a timing diagram illustrating the pel processor 18 control timing for a setup cycle.
Figure 12:
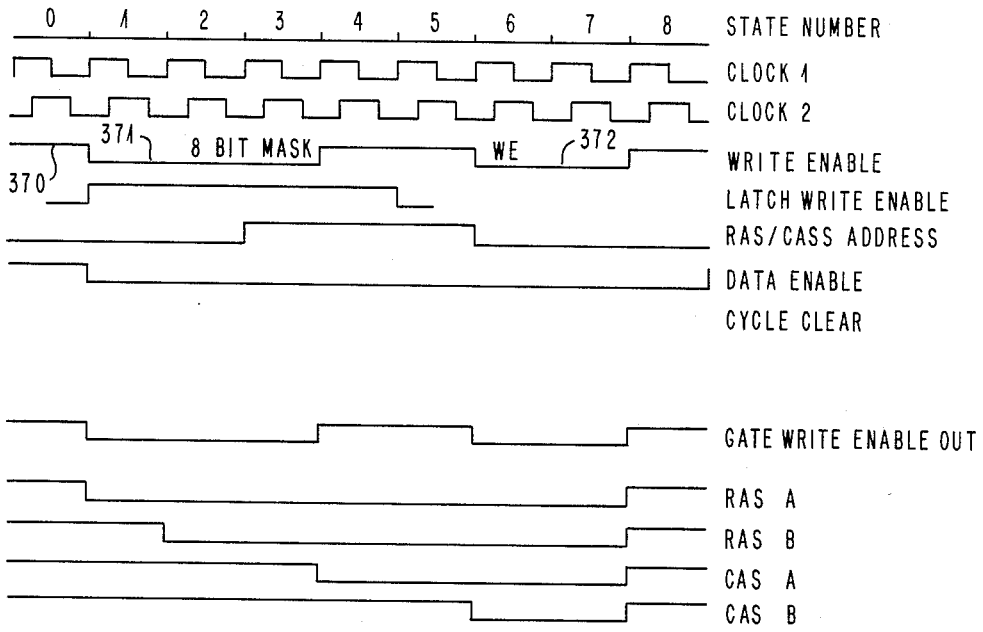
FIG. 12 is a timing diagram for the pel processor 18 control circuitry executing a memory cycle store operation.

The circuitry 52 receives several control signals from the pel processor 18 control circuit 44 (FIG. 6). FIG. 10 illustrates the control flow for operating the write mask circuitry of FIG. 9. Initially the control logic is in an idle state 730 until it is determined that it is to start a setup cycle. This is determined in step 732. The setup cycle and memory cycle generation are covered in detail in U.S. patent application No. 07/013,849 filed Feb. 12, 1987. Upon the occurrence of the setup cycle, the control circuitry in step 734 resets all the flip flops 80 of FIG. 9. This is accomplished by the control circuitry 44 providing a signal on line 60C to the write enable decode logic 98 (FIG. 9). In a timing diagram illustrated in FIG. 11, this signal is line 350. Returning to FIG. 10, the control logic 44 then proceeds to step 740 which is a decision step to determine whether the operation to be performed is a line draw or a bit block transfer (BITBLT). If the operation is a BITBLT operation, the control circuitry 44 proceeds to step 742 to provide the write enable generation logic 52 with a signal to set the write mask from the system using data stored in the write register 92 as the mask. Referring to FIG. 9, this is accomplished by the transmission of a signal on line 60D which is the first of the timing pulses on line 354 (FIG. 11). This signal is provided to write enable decode logic 98 in FIG. 9 which in turn selectively provides signals on lines 91A–P to the 16 flip flops 80 to selectively set these flip flops 80. The register 82 is then clocked by line 60E to provide the 16 mask bits output to an AND gate 84. The register 82 is clocked by a signal on line 353 (FIG. 11). The AND gate 84 also receives an input on line 60B which is line 370 in FIG. 12. FIG. 12 is a timing diagram of the output of the control logic 44 during a memory cycle. Line 370 includes time periods 371 and 372. Time period 371 provides the active signal to AND gate 84. Time period 372 is the active write enable control time period to the memory 22. In this embodiment the memory 22 further includes a latch which gates the write enable signals on bus 20. The time period 372 provided to memory 22 is used internally by memory 22 to enable the write enable control signals to their respective memory cells to provide the access to the memory cells.

The actual performance of a bit block transfer by the write enable circuitry in FIG. 9 includes the loading of the 16 bits from the system bus 16 into the register 92. Register 92 acts as a set register or is a shift register according to the function being performed by the write enable mask circuitry 52. When performing a bit block transfer operation register 92 acts as a set or static register. The output of register 92 is passed through a Y direction barrel shifter 94 and X direction barrel shifter 96. These two barrel shifters effectively align the 16 bit (4 pel×4 pel) pattern to provide the appropriate addresses relative to the screen grid address (see FIG. 4). This is important because this enables the 4×4 pel module to be written on any pel boundary in the display screen. After the 16 pel pattern from register 92 has been aligned with the X and Y addresses through the Y direction barrel shifter 94 and the X direction barrel shifter 96, the 16 bits are input to the write enable decode logic 98 which at the appropriate time sets or does not set the flip flips 80 via lines 91A–91P. The outputs are then provided as previously discussed.

FIG. 13 illustrates an example of a pattern that would be output in a bit block transfer operation. The normal application of the use of such capability is when characters are being written to the screen. In a bit block transfer operation, a 4×4 pel array will normally include only a section of that character. In FIG. 13 a 4×4 array 501 is illustrated that includes several active pel regions such as square 502. Note that the 4×4 array 501 includes its absolute square addresses from 0 in the upper right hand corner progressing to 15 in the lower left hand corner. These are the reference addresses for the squares in the array as previously illustrated in FIG. 5. Note that the active pels in the array 501 have absolute addresses of 5, 8, 9, 10 and 15.

Figure 14:
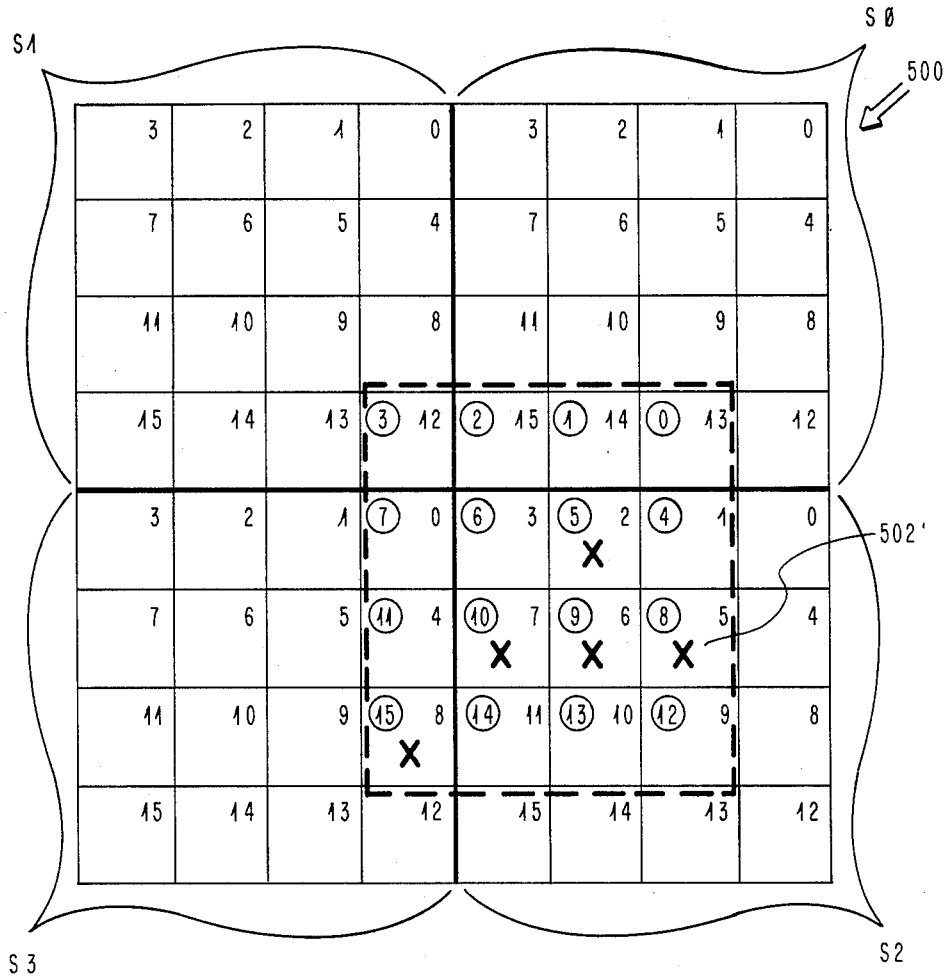
FIG. 14 is an illustration of a four section array of a display screen including the internal pel addresses.

FIG. 14 illustrates a four section portion of the display screen that is to display the 16 pel array 501. Each one of the four squares S0 through S3 includes 16 individual pels numbered in accordance with the convention of FIG. 5. Since any area can be addressed exclusive of the square or square that the 4×4 pel array is located, some means must be provided to align the 4×4 pel array that is to be written with the actual screen grid square addresses provided. This is the function of the Y direction barrel shifter 94 and the X direction barrel shifter 96. These two barrel shifters 94 and 96 receive Y address bits on line 56A and X address bits on line 56B from the memory address circuitry 50 of the pel processor 18. The address circuitry, as discussed in U.S. patent application No. 013,814 filed Feb. 12, 1987 discusses in detail the operation of the output of the addressing circuitry 50 for both a bit block transfer and a line draw application. The pel processor 18 receives from the system processor 10 or the signal processor 14 a pel location indicating the location of where the 4×4 pel matrix (such as 501) is to be written.

In this example illustrated in FIG. 14 the upper left hand bit is specified from the system processor together with the X direction as being positive and the Y direction being negative. In other words, pel 12 of square 1 (S1) is being specified as the location of the upper left hand corner of the 4×4 matrix 501. The barrel shifters 94 and 96 translate the absolute addresses of the 4×4 array 501 (represented as the circled numbers in the upper left hand corner of each of the pel squares) into the absolute addresses for the pel locations in the squares (represented in FIG. 14 as the numbers in the upper right hand portion of a pel squares). By providing this address translation capability to the write enable mask circuitry, the pel processor 18 is capable of writing any 4×4 pel matrix on any pel boundary.

A write enable generation circuit 52 of FIG. 9 also provides capability when a line draw function is being performed. This capability for line draw functioning provides for the pattern generation for the line being drawn. In other words, when a line is drawn on a screen, it can be drawn as a pattern of certain pels on and certain pels off. This is very useful in drafting to distinguish one line from another line. When providing the pattern function to the line draw task, the write enable mask generation circuit 52 is loaded with the pattern scale in register 86 from a system bus 16. The pattern scale register 86 contains the number designating the number of pels to be patterned, i.e., the number of pels to be turned off and turned on in an alternating fashion. The scale register 86 is then loaded through multiplexor 88 into counter 90 which counts down through the scale number to provide a clocking signal to register 92. Register 92 for the line draw function acts as a shift register and shifts when a clock signal is received from the counter 90. Register 92 contains a second level of pattern provided from the system bus 16. A simple example of the operation of the scale number in register 86 relative to the pattern number contained in shift register 92 is an example of where eight bits are to be turned on by followed by four bits to be turned off. In this example, the scale number would be the smallest resolution of the pattern, four bits. The pattern is designated by the pattern number in register 92, i.e., 110110 . . . This number in register 92 signifies that the first eight bits are to be turned on and the next four bits are to be turned off as desired. The signal designating which pels are to be turned on and turned off are provided to the write enable decode logic 98 via line 95. In other words, the barrel shifters 94 and 96 are not involved in the line draw operation. The line draw circuit 50, also discussed in U.S. patent application No. 013,814 filed Feb. 12, 1987 provides the addresses of the pels on lines 56. These are the same addresses that are provided on lines 56A and 56B previously discussed. Therefore, for each pel being addressed on lines 56, the write enable decode logic 98 receives an on or off signal on line 95. Upon receiving information designating the state of the 16 pels, the write enable decode logic 98 then provides a set signal on lines 91A-P to the flip flops 80 as previously discussed.

FIG. 15 illustrates a simple pattern line contained in a screen 510. The line contains an active portion 12 and an inactive portion 514 to provide a dashed line. This circuitry in FIG. 9 can also provide another capability where two lines can be drawn to be intersecting but yet maintain the pattern progression between the two lines. This is illustrated in FIG. 16. In FIG. 16 the line in screen 520 contains a series of active pels 522 and a series of inactive pels 524. Section 526 represents a corner and in accordance with the operation of this circuit in FIG. 9 will contain this same number of active pels as that of section 522. This is made possible by the output of counter 90 being provided to the system bus 16. This number from register 90 is stored by this system processor 10 or signal processor 14 until the second intersecting line is drawn. When this occurs the register 90 is reloaded with the remaining count from the previous line from bus 16 via the multiplexor 88 to enable the drawing of the new line with the pattern restarted where it left off from the previous line.

A further capability of the circuitry in FIG. 9 is illustrated in FIG. 17. FIG. 17 illustrates an active drawing area 530. This active area includes a line including pattern sections 532 and 534. In actual calculation in this instances, the line includes a section that is drawn off of the active area 530 as designated by 536. This is termed clipping or scissoring where the section 536 will not be displayed to a user. However, the present invention provides for the continuation of the computation of the line and the pattern of the line in a manner that a section that reappears in the active drawing area 530 (such as 538) will contain the properly computed pattern as if the total line segment was contained in the active draw area 530. This is made possible by a signal on line 60D received from the write enable logic decode circuitry 98 from the line drawing circuitry 50. In the line draw circuit 50 that computes the addresses, an X comparator and Y comparator registers are provided to determine when the addresses being computed are outside the active viewing area. When the addresses are outside the active viewing area, a signal is provided on line 60D to the write enable decode logic 98 which in turn provides a reset signal on line 93 to all of the flip flops 80. This prevents any write enables from being provided by the write enable circuitry 52 and thus no drawing will take place outside this active area. It should be understood that this active area may be a subset of the actual screen being displayed. Therefore, this clipping capability will still allow the computation of the addresses to continue together with the computation of the pattern for any lines outside this active area while still enabling the correct line patterning when the line computation reenters the active display area.

This above capability is important because the lines drawn in this fashion may then be stored and rearranged so that they may be later displayed in the active display region without their patterns being recomputed.

Although the invention has been described with reference to this specific embodiment, this description is not meant to be construed in a limiting sense. Various modifications of the disclosed embodiment, as well as other embodiments of the invention, will become apparent to those persons skilled in the art upon reference to the description of this invention. It is, therefore, contemplated that the appended claims will cover any such modifications or embodiments as fall within the true scope of the invention.

We claim:

1. A graphics display system comprising:

means for receiving graphics information to be displayed;

memory means for storing said graphics information to be displayed in a memory array including a portion directly corresponding to an image area for display and said memory means for providing a single access operation to said array during a memory cycle time period;

means connected to said receiving means and said memory means for providing graphics information to any N by M portion of the memory means array during a single one of said memory cycle time periods wherein N and M are integers each greater than 1 wherein said N by M portion can be located at any position in said memory array; and display means connected to the memory means for displaying said graphics information in said image area array portion.

2. A graphics display system according to claim 1 wherein said means for providing graphics information to the memory means includes control means for providing control signals to said memory means, said control means including means for providing control signals indicating data to be provided to said memory means and said control means including addressing means for providing unique addresses to said memory means independent of any preceding or subsequent addresses so provided.

3. A graphics display system according to claim 2 wherein said control means includes a register that contains an activated picture element pattern for qualifying the data to be provided to said memory means.

4. A graphics display system according to claim 3 wherein said control means register designates which control signals are to be transmitted to the memory means to qualify the data provided to said memory means.

5. In a graphics processing system including a processor for providing graphics information and a memory for storing graphics information in an image array for display, an interface circuit connecting the processor to the memory comprising:

means for addressing any N by M portion of said memory array during a single memory access period wherein M and N are integers each greater than 1 wherein said N and M portion can be located at any position in said memory array; and means for providing graphics information to the addressed portion of said memory array.

6. A graphics display system according to claim 5 wherein said means for providing graphics information to the memory means includes control means for providing control signals to said memory, said control means including means for providing control signals indicating data to be provided to said memory and said addressing means including means for providing unique addresses to said memory independent of any preceding or subsequent addresses so provided.

7. A graphics display system according to claim 6 wherein said control means includes a register that contains an activated picture element pattern for qualifying the data to be provided to said memory.

8. A graphics display system according to claim 7 wherein said control means register designates which control signals are to be transmitted to the memory to qualify the data provided to said memory.

9. A graphics processing system including graphics information to be displayed, said system comprising:

means for receiving said graphics information to be displayed and for providing picture element data therefrom, said picture element data provided to a memory means together with timing signals that define individual memory access periods during which picture element data can be written to or read from said memory means;

said memory means including an array for storing picture element data in an image memory area corresponding to the image to be displayed in response to said timing signals; and wherein said means for providing said picture element data to said data means includes means for providing any N by M array of picture element data to said memory means during a single memory access period where N and M are integers greater than 1 wherein said N by M portion can be located at any position in said memory means.

10. The graphics processing system according to claim 9 wherein said picture element data includes a plurality of bits for each individual picture element.

11. The graphics processing system according to claim 10 wherein said means for providing graphics information to the memory means includes control means for providing control signals to said memory means, said control means including means for providing control signals indicating picture element data to be provided to said memory means and said control means including addressing means for providing unique addresses to said memory means independent of any preceding or subsequent addresses so provided.

12. The graphics processing system according to claim 11 wherein said control means includes a register that contains an activated picture element pattern designating at least one of the control signals to be provided to said memory means.

13. The graphics processing system according to claim 12 wherein said control means register designates which control signals to be transmitted to the memory means to qualify the data provided to said memory means.

14. A graphics processing system including graphics information to be displayed, said system comprising:

means for providing picture element data corresponding to said graphics information to a memory means together with timing signals that define individual memory access periods during which picture element data can be written to or read from said memory;

said memory means including an array for storing picture element data in an image memory area corresponding to the image to be displayed and in response to said timing signals; and wherein said means for providing said picture element data to said data means includes means for providing any N by M array of picture element data to said memory means during a signal memory access period and wherein said means includes control of at least one of said timing signals to selectively provide individual ones of said N by M picture elements to said memory means and where N and M are greater than 1 wherein said N by M portion can be located at any position in said memory means.

15. The graphics processing system according to claim 14 wherein said picture element data includes a plurality of bits for each individual picture element.

16. The graphics processing system according to claim 15 wherein said means for providing graphics information to the memory means includes control means for providing control signals to said memory means, said control means including means for providing control signals indicating picture element data to be provided to said memory means and said control means including addressing means for providing unique addresses to said memory means independent of any preceding or subsequent addresses so provided.

17. The graphics processing system according to claim 16 wherein said control means includes a register that contains an activated picture element pattern designating at least one of the control signals to be provided to said memory means.

18. The graphics processing system according to claim 17 wherein said control means register designates which control signals are to be transmitted to the memory means to qualify the data provided to said memory means.

19. A graphics processing system for displaying at least two patterned lines forming an intersection, said system comprising:

means for computing which picture elements in an array of picture elements are to be activated to display said lines;

means for regulating the activation of said computed picture elements to display said lines by providing repeatable picture element pattern having at least a first predefined number of activated picture elements adjacent to a second predefined number of non-activated picture elements for said lines including means for providing display pattern continuity along said intersection of said lines; and display means for displaying said activated picture elements.

20. A graphics processing system according to claim 19 wherein said regulating means includes a counter means for computing which picture elements defining the line are to be activated to display said lines according to the pattern wherein said counter means includes a register means for storing a pattern count upon the completion of a first line to be used to initiate a pattern computation for the intersecting line.

21. A graphics processing system for displaying a patterned line wherein an intermediate portion of the line is outside a predetermined region for display, said system comprising:

means for computing which picture elements in an array of picture elements are to be activated to display said line;

means for regulating the activation of said computed picture elements to display said lines by providing a repeatable picture element pattern having at least a first predefined number of activated picture elements adjacent to a second predefined number of non-activated picture elements continuity along said line portion outside of said predetermined region for display; and display means for displaying said activated picture elements.

22. A graphics processing system according to claim 21 where in said regulating means includes register means having the boundary of the predetermined region stored therein and means for providing activation of those computed picture elements to display said pattern lines only within the predetermined region while providing a pattern computation for the portion not being displayed.

* * * * *

UNITED STATES PATENT AND TRADEMARK OFFICE

CERTIFICATE OF CORRECTION

PATENT NO. : 4,808,986

DATED : February 28, 1989

INVENTOR(S) : Robert L. Mansfield et al

It is certified that error appears in the above-identified patent and that said Letters Patent is hereby corrected as shown below:

Col. 17, line 5, after "signals" insert --are--.

Col. 17, line 23, delete "signal" and insert --single--.

Col. 18, line 10, after "providing" insert --a--.

Col. 18, line 39, after "elements" insert --for said displayed line including means for providing pattern--.

Signed and Sealed this

Twenty-fourth Day of December, 1991

*Attest:*

HARRY F. MANBECK, JR.

*Attesting Officer*

*Commissioner of Patents and Trademarks*